US005348218A

United States Patent [19]

Haire et al.

[11] Patent Number: 5,348,218

[45] Date of Patent: Sep. 20, 1994

[54] CONCESSION TRAY

[75] Inventors: James P. Haire, Fallston; Steven Attman, Owings Mills, both of Md.

[73] Assignee: Alpha Products, Inc., Savage, Md.

[21] Appl. No.: 63,293

[22] Filed: May 19, 1993

[51] Int. Cl.[5] ..... B65D 5/36; B65D 5/48

[52] U.S. Cl. ..... 229/117.07; 229/1.5 H; 229/120.14; 229/164; 229/904

[58] Field of Search ..... 229/1.5 H, 164, 904, 229/120.14, 120.15, 120.16, 117.07; 206/561, 564, 565; 220/737, 738; 248/311.2

[56] References Cited

U.S. PATENT DOCUMENTS

| | | | |
|---|---|---|---|
| 2,679,971 | 6/1954 | Goldberg | 229/904 |
| 2,794,585 | 6/1957 | Wagner | 229/904 |
| 2,833,458 | 5/1958 | Toensmeier | 229/904 |
| 3,174,674 | 3/1965 | Wagner | 229/904 |
| 3,189,247 | 6/1965 | Wischusen | 229/904 |
| 3,434,649 | 3/1969 | Goings | 229/904 |
| 4,489,879 | 12/1984 | Mode | 229/904 |
| 4,757,937 | 7/1988 | Maio et al. | 229/904 |
| 4,893,773 | 1/1990 | Fujimoto | 248/311.2 |

FOREIGN PATENT DOCUMENTS

| | | | |
|---|---|---|---|
| 651409 | 1/1963 | Italy | 229/117.07 |
| 417461 | 2/1967 | Switzerland | 229/117.07 |

OTHER PUBLICATIONS

Tray sold or offered for sale by applicant more than one year prior to May 19, 1993, such tray differing from the invention claimed in the manner set forth in the Information Disclosure Statement filed May 19, 1993.

*Primary Examiner*—Gary E. Elkins

[57] ABSTRACT

A concession tray comprises a base panel, side panels and end panels. The end panels are relatively higher than the side panels. The tray includes a cup holder which comprises adjacent portions of the base panel and an end panel, respectively. In cooperation with portions of the end panel, the cup holder stably supports a broad range of sizes of beverage cups. The concession tray is formed from paperboard having a thickness of at least 0.026 inches and the maximum linear dimension of any side of the tray does not exceed about 13.5 inches.

20 Claims, 2 Drawing Sheets

CONCESSION TRAY

BACKGROUND OF THE INVENTION

The present invention relates to a concession tray. A concession tray is a tray designed for carrying food items, for example, away from a concession selling take-out food. The invention is particularly concerned with a concession tray suitable for carrying both beverage cups and other food items together.

Stability and strength are very important qualities of a concession tray. At the same time, however, there is substantial incentive to keeping the cost quite low because the concession owner is not generally able to charge a fee for the tray.

In addition to being strong, stable and inexpensive, a concession tray must accommodate an adequate number of food items and beverage cups. Making a tray large enough to accommodate large items generally leads to instability. Therefore, the goals of achieving sufficient capacity and of achieving sufficient strength and stability are generally inconsistent with each other. Further, it is highly desirable for a concession tray to accommodate food items of various sizes and, particularly, beverage cups of varying sizes. It is also important for a concession tray to be easy to carry in a highly stable manner in view of the fact that food purchases including liquid beverages are often carried substantial distances in the tray.

While meeting all of the above-identified objectives, it is also important that a concession tray may be efficiently and easily stored inasmuch as substantial quantities are typically stored at food concessions.

Accordingly, it is an object of the invention to provide a concession tray which has a substantial capacity for food items and, particularly, the ability to accommodate beverage cups of varying sizes.

It is an object of the invention to provide such a concession tray which stably holds food items and beverage cups, and is quite stable and easy to carry when fully or partially loaded.

A further object of the invention is to provide a concession tray having the above-described desirable characteristics, and which is easily stored at a food concession.

Yet another object of the invention is to provide such a tray which is inexpensive and can be quickly and easily prepared for use by a consumer.

SUMMARY OF THE INVENTION

Accordingly, the present invention comprises a concession tray for carrying food items and beverage cups. The tray comprises a base, side and end panels, and is selectively configurable in a folded configuration or in an erected configuration. In the folded configuration, the tray is substantially flat and the side and end panels lie substantially adjacent to the base. In the erected configuration, the side and end panels are substantially perpendicular to the base.

A cup holder is associated with at least one of the end panels. The cup holder comprises a first part formed of a portion of the end panel, and a second part formed of a portion of the base. The cup holder is selectively positioned in a retracted position with the first and second parts substantially coplanar with the end panel and base, respectively, or an extended position with the first part and second part substantially perpendicular to the end panel and base, respectively.

According to the invention, the end panels are higher than the side panels whereby the cup holder may be substantially as high as the side panels. Additionally, the end panels comprise extended portions which are attached to the side panels, whereby the higher end panel portions engage at two points a cup placed in the cup holder.

In a preferred embodiment of the invention the tray is constructed of paperboard having a minimum thickness of 0.026 inches and the greatest linear dimension along any side or end panel of the tray does not exceed about 13.5 inches. This results in a concession tray which is cost-effective yet sufficiently rigid, and has cup holders sufficiently rigid, to stably carry food items and cups. This thickness, together with other features of the invention, also provides for adequate locking of the concession tray in the erected position.

BRIEF DESCRIPTION OF THE DRAWINGS

The above-described objects and features of the invention will be more fully understood in view of the following description of a preferred embodiment of the invention, as illustrated in the accompanying drawings in which.

DESCRIPTION OF A PREFERRED EMBODIMENT

Figure 1:
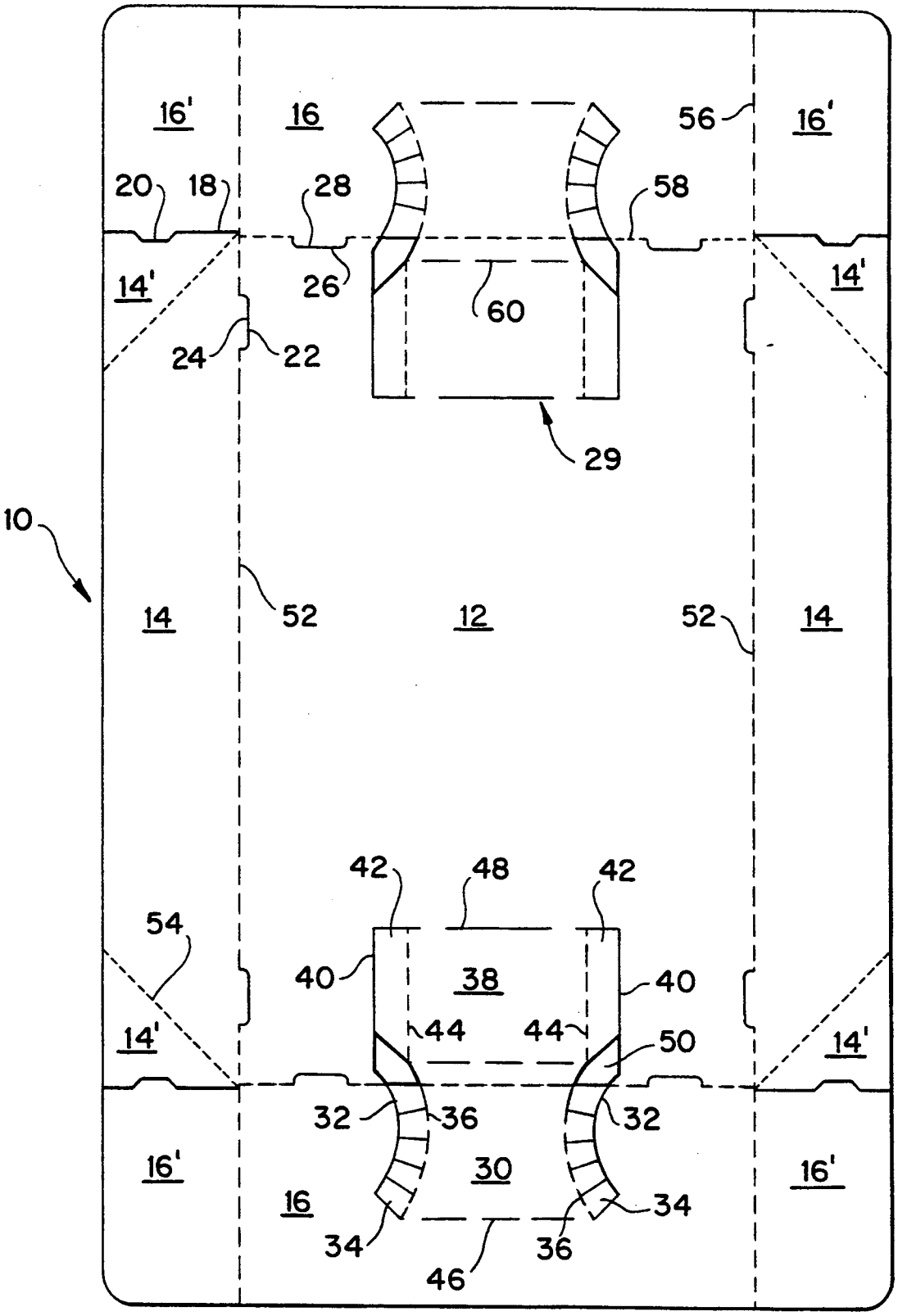
FIG. 1 is a plan view of a cut and scored paperboard blank used for forming a concession tray according to the present invention.

FIG. 1 illustrates a blank for forming a concession tray according to the invention, designated generally by reference numeral 10. The blank of the preferred embodiment is formed from paperboard having a minimum thickness of 0.026 inches.

Blank 10 comprises a base panel 12, side panels 14, and end panels 16. Side panels 14 include triangular portions 14'. End panels 16 include extended portions 16'. The purposes of portions 14' and 16' will be described in greater detail hereinafter.

In FIG. 1, cut lines (lines along which the blank is cut to form the tray) are designated generally by solid lines. Fold lines are designated generally by dash lines.

As illustrated in FIG. 1, extended portions 16' are separated from side panels 14, 14' along cut lines 18. The same structure is repeated at each corner of blank 10. A tab 20 associated with extended portion 16' is formed by a deviation in the cut line 18.

Cut lines 22 formed along portions of the intersection of base panel 12 and side panels 14 form, when the tray is erected, slots in the base panel for receiving tab 20. Tab 20 and slot 22 cooperate to maintain the tray in the erected position in a manner to be described in greater detail hereinafter. Cut lines 22 also form extensions 24 in the side panels 14. Additional cut lines 26 formed along portions of the fold line at the intersection of base panel 12 and end panels 16 form similar extensions in the end panels. The purpose of cut lines 22 and 26 will become more apparent from the description below of the erected tray.

At least one cup holder 29 is associated with at least one end panel 16. In the illustrated preferred embodiment, a cup holder 29 is associated with each end panel.

Each cup holder comprises a first part 30 formed from the associated end panel and cut from the end panel along arcuate cut lines 32. First part 30 comprises a plurality of tabs 34 which are relatively flexible. In the illustrated embodiment, tabs 34 are hinged about arcuate fold lines 36.

A second part 38 of the cup holder is cut from base panel 12 along cut lines 40. Second part 38 comprises tabs 42 which, like tabs 34, are flexible. In the illustrated embodiment tabs 42 are hinged about fold lines 44. Tabs 34 and 42 accommodate beverage cups of different sizes as will be described in greater detail below.

First part 30 of the cup holder is hinged to end panel 16 along fold line 46. Second part 38 of the cup holder is hinged to base panel 12 along fold line 48. Portions 50 of base panel 12 on either side of cup holder 29 may be removed from blank 10.

In assembling a concession tray from the blank illustrated in FIG. 1, side panels 14 are first folded inwardly along fold lines 52 to overlie base panel 12. Triangular portions 14' are then folded back along fold lines 54. Extended portions 16' of end panel 16 are folded inwardly along fold lines 56 to overlie end panels 16. These elements are then folded inwardly along fold lines 58 with the result that extended portions 16' overlie triangular portions 14' of side panels 14. Portions 14' and 16' are secured together such as by gluing.

The thus-assembled tray is in a folded configuration wherein it lies substantially flat. The side panels and end panels lie substantially adjacent to base panel 12. In this configuration, a plurality of the concession trays can be easily stacked, stored and dispensed to customers.

To set up the tray into the erected position for use in carrying foods and beverages, a customer would lift end panels 16 and side panels 14 upwardly away from base panel 12. This results in an unfolding action of triangular portions 14' and side panels 14 which, in the folded configuration of the tray, are folded about lines 54. Simultaneously, tab 20 is drawn in an arcuate path across base panel 12, as shown at 20' in FIG. 2. Tab 20 is drawn toward the crease formed along fold line 52, and into the slot formed in base panel 12 by cut line 22.

Figure 2:
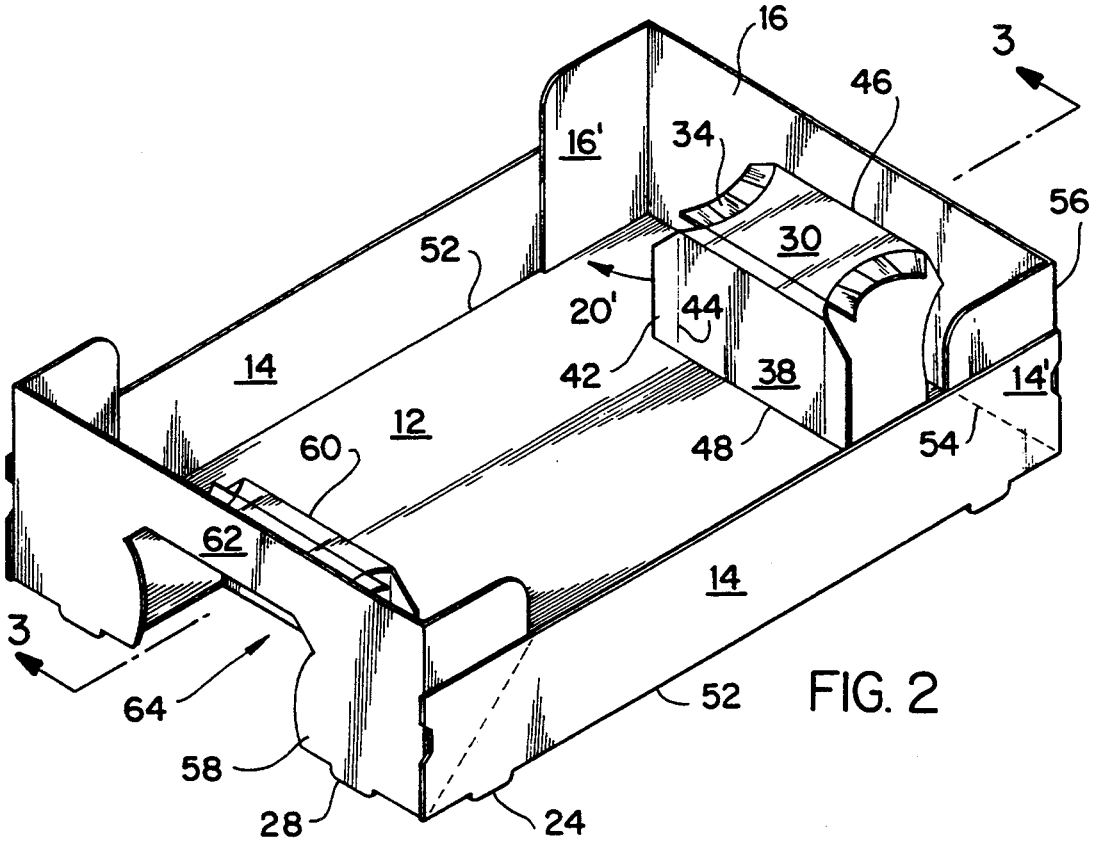
FIG. 2 is a perspective view of a concession tray according to the invention in the erected position with the cup holders thereof in the extended position.
Figure 3:
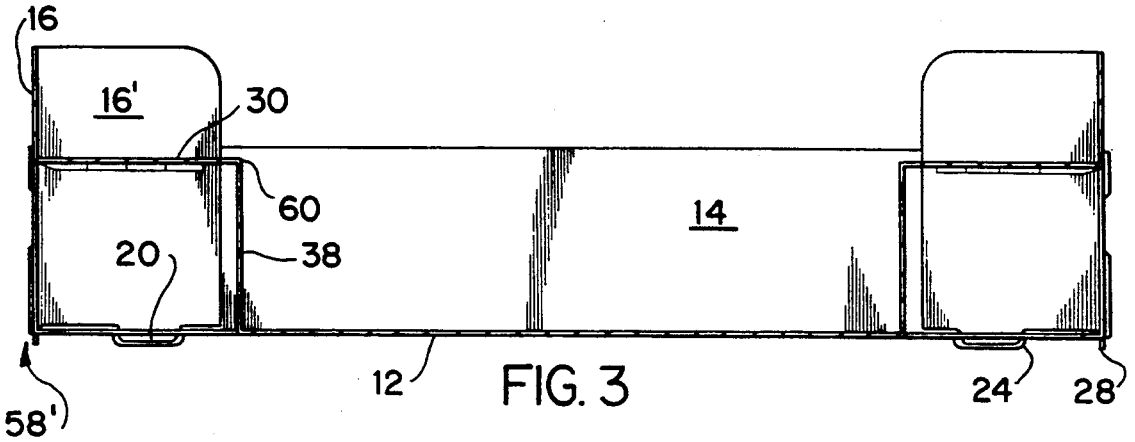
FIG. 3 is a sectional view along line 3—3 of FIG. 2.

Tabs 20 in the slots formed by cut lines 22 maintain extended portions 16' flush against side panels 14, thus maintaining the tray in the erected configuration as illustrated in FIGS. 2 and 3. In a preferred embodiment, tabs 20 are long enough to extend clearly below the bottom surface of base panel 12, as illustrated in FIG. 3. This securely maintains the tray in the erected configuration, particularly when the tray is comprised of paperboard at least 0.026 inches in thickness.

Initially, when the tray is placed in the erected configuration as described above, each cup holder 29 is in the retracted position with the first part 30 thereof coplanar with end panel 16 and the second part 38 thereof coplanar with base panel 12. This forms a tray with a fully flat bottom. To place each cup holder in the extended position, it is only necessary to press inwardly generally at fold line 58, as shown at 58' in FIG. 3. This set-up step can be quickly and easily performed by a customer. This inverts the cup holder, whereby it extends generally inwardly. An additional fold line 60 facilitates inward inversion of the cup holder and becomes a folded edge when the cup holder is in the extended position as seen in FIGS. 2 and 3.

In the extended position of cup holder 29, first part 30 is substantially perpendicular to end panel 16 and substantially parallel to base panel 12. Second part 38 is substantially perpendicular to base panel 12 and substantially parallel to end panel 16. Tabs 34 associated with first part 30 are generally horizontal, while tabs 42 associated with second part 38 are generally vertical. This forms cup holding positions on each side of holder 29. A cup may be readily retained between each side of cup holder 29 and the corner of the tray formed by end panel 16 and the adjacent extended portion 16'.

End panel 16 and extended portion 16' are higher than side panels 14. Consequently, second part 38 of the cup holder can be substantially as high as side panels 14. This necessarily raises fold line 46 to substantially the height of the side panels. However, because the end panels are still higher, portions 62 of the end panels serve to maintain the continuity and integrity of the side panels completely across the length thereof. The elevated top edges of end panel 16 and extended portions 16' also engage, at at least two points, a cup placed in the cup holder portion of the tray. This engagement at relatively high positions on the cup serves to secure the cup in a highly stable manner.

Tabs 34 and 42 enable cup holders 29 to accommodate beverage cups of varying size. As a cup is placed in a cup retaining position between cup holder 29 and an adjacent extended portion 16' the cup will engage both portions 16' and tabs 34 (assuming that the cup is of a sufficient lateral dimension). If the cup has a lateral dimension somewhat larger than the distance between extended portion 16' and tabs 34, tabs 34 will be deflected downwardly. However, the resilience of the paperboard as tabs 34 are folded or bent downwardly will cause tabs 34 to press against the cup, thereby retaining and stabilizing the cup in its proper position. Similarly, if the cup is of such lateral dimension that it contacts both end panel 16 and the adjacent tab 42 of second part 38 of the cup holder, tab 42 will flex outwardly about fold line 44, thereby accommodating the dimension of the cup. Again, the resilience of the paperboard will press tab 42 against the cup, thereby retaining the cup in proper position. Of course, the larger the cup, the greater will be the deflection of tabs 34 and/or 42. This combination of vertical and horizontal flexible tabs enables a concession tray according to the invention to accommodate stably a broad range of cup sizes. Together with the relatively high end panels 16 and extended portions 16', a tray having cup holders according to the present invention accommodates a broad range of cup sizes in a surprisingly effective manner.

In the extended position, as illustrated in FIGS. 2 and 3, each cup holder 29 also forms a handle for carrying the concession tray of the invention in an advantageous manner. The fingers of an individual may be inserted through the opening 64 formed in end panel 16, thus engaging the lower surface of first part 30 of the cup holder. Portion 62 of end panel 16 and second part 38 of the cup holder are attached to and perpendicular to part 30 at opposite ends thereof. Consequently, portions 62 and 38 rigidify and stabilize first part 30, thus forming a strong and stable handle for carrying the tray.

Food items and cups are supported in the tray on base panel 12, at the lowest part of the tray. Surface 30, which forms the handle, is elevated with respect to the base panel. Consequently, the carrying support when held by handles 30 is above the support surface for the food products and, therefore, generally above the center of the gravity of the loaded tray. Consequently, the tray is naturally stable when loaded and carried. Further, because the handles formed by cup holders 29 are along an axis of symmetry of the tray, the tray is naturally balanced. Because opening 64 is bordered on both sides by portions of end panel 16, the hand cannot readily slip laterally, further enhancing balance and stability.

Extensions 24 and 28, resulting from cut lines 22 and 26 respectively, form foot-like structures in the erected tray as shown in FIGS. 2 and 3. Additionally, as mentioned above, cutting away of extensions 24 from base panel 12 form slots which receive tabs 20 thus locking the tray in the erected configuration.

During assembly of the tray, as described above, tabs 20 overlie extensions 28 when extended portions 16' are folded to overlie end panels 16. When the end panels 16 and extended portions 16' are folded about line 58, extension 28 pivots together with tab 20 as end panel 16 and extended portion 16' pivot, thus enabling the tray to be folded without damaging tabs 20.

The dimensions of the tray according to the invention, as well as the material from which it is formed, are of importance if the concession tray is to function properly. The preferred embodiment is formed of paperboard of at least 0.026 inches in thickness. At this thickness, the greatest dimension of a side or end panel should be about 13.5 inches. In the preferred embodiment illustrated, side panels 14 are longer than end panels 16, and side panels 14 are about 13.5 inches or less in length.

This combination of linear dimensions and paperboard thickness properly controls the torsional stiffness of the tray as a whole. Further, locking tabs 20 when formed of such material are sufficiently rigid to securely lock the tray in the erected configuration without experiencing damage to the tabs. End panels 16 and extended portions 16' are sufficiently rigid and stable, when formed of material of at least 0.026 inches in thickness, to adequately stabilize a large beverage cup when full of liquid beverage. Similarly, when the tray of the invention is formed of such material, cup holder 29, tabs 34 and tabs 42 have sufficient rigidity and strength to properly stabilize a full beverage cup of large size, and to afford proper strength to the cup holder to perform the carry handle function described above.

The invention is not limited to the details described with respect to the preferred embodiment. Rather, the invention is subject to variations and modifications, and is limited only by the following claims.

We claim:

1. A concession tray for carrying food items and cups, comprising:

a base panel, side panels hinged to said base panel about fold lines, and end panels hinged to said base panel about fold lines; said end panels intersecting said side panels and forming a folding structure at the intersections whereby said tray may be selectively set in a folded configuration wherein said tray is substantially flat with said side and end panels lying substantially adjacent to said base panel or in an erected configuration with said side panels and end panels substantially perpendicular to said base panel;

a cup holder associated with at least one of said end panels, said cup holder comprising a first part formed of a portion of said one end panel and hinged to said one end panel about a fold line, and a second part formed of a portion of said base panel and hinged to said base panel about a fold line, whereby said cup holder may be selectively set in a retracted position with said first part substantially coplanar with said one end panel and said second part substantially coplanar with said base panel or an extended position with said first part substantially perpendicular to said one end panel and substantially parallel to said base panel and said second part substantially perpendicular to said base panel and substantially parallel to said one end panel;

wherein said end panels are higher than said side panels in said erected configuration and said second part of said cup holder is substantially as high, in said extended position, as said side panels;

said end panels comprising extended portions which are attached to said side panels, whereby said end panels form relatively high portions on each side of the intersections of said end panels and adjacent side panels, whereby said relatively high portions on each side of the intersections may engage at two points a cup placed in said cup holder;

wherein said tray is constructed of paperboard having a minimum thickness of 0.026 inches and the length and width of said base panel of said tray each does not exceed about 13.5 inches.

2. A concession tray as in claim 1, wherein said first and second parts of said cup holder are hinged together.

3. A concession tray as in claim 1, wherein said first part of said cup holder comprises flexible tabs for engaging a cup within said holder, whereby said cup holder stably holds cups of varying diameters.

4. A concession tray as in claim 3, wherein said second part of said cup holder comprises at least one flexible tab for engaging a cup within said holder, whereby said cup holder stably holds cups of varying diameter.

5. A concession tray as in claim 1, wherein said extended portions of said end panels comprise locking tabs and said base panel comprises slots, wherein said locking tabs are received within and extend through said slots to retain said tray in the erected configuration.

6. A concession tray as in claim 5 wherein said locking tabs extend, in the erected configuration of said tray, through said slots and terminate at a position below the bottom surface of said base panel.

7. A concession tray as in claim 1, wherein said cup holder, in the extended position, forms a handle for carrying said tray.

8. A concession tray as in claim 1, wherein said cup holder, in the extended position, forms a handle for carrying said tray, said first part of said cup holder forming a finger engaging surface of said handle for carrying said tray, said finger engaging surface being spaced above the base panel of said tray when said tray is in the erected configuration and said cup holder is in the extended position.

9. A concession tray for carrying food items and cups, comprising:

a base panel, side panels hinged to said base panel about fold lines, and end panels hinged to said base panel about fold lines; said end panels intersecting said side panels and forming a folding structure at the intersections whereby said tray may be selectively set in a folded configuration wherein said tray is substantially flat with said side and end panels lying substantially adjacent to said base panel or in an erected configuration with said side panels and end panels substantially perpendicular to said base panel;

a cup holder associated with at least one of said end panels, said cup holder comprising a first part formed of a portion of said one end panel and hinged to said one end panel about a fold line, and a second part formed of a portion of said base panel and hinged to said base panel about a fold line, whereby said cup holder may be selectively set in a retracted position with said first part substantially coplanar with said one end panel and said second part substantially coplanar with said base panel or an extended position with said first part substantially perpendicular to said one end panel and substantially parallel to said base panel and said second part substantially perpendicular to said base panel and substantially parallel to said one end panel;

wherein said end panels are higher than said side panels in said erected configuration and said second part of said cup holder is substantially as high, in said extended position, as said side panels;

said end panels comprising extended portions which are attached to said side panels, whereby said end panels form relatively high portions on each side of the intersections of said end panels and adjacent side panels, whereby said relatively high portions on each side of the intersections may engage at two points a cup placed in said cup holder;

wherein the length and width of said base panel of said tray each does not exceed about 13.5 inches.

10. A concession tray for carrying food items and cups, comprising:

a base panel, side panels hinged to said base panel about fold lines, and end panels hinged to said base panel about fold lines, said end panels intersecting said side panels and forming a folding structure at the intersections whereby said tray is movable between a folded substantially flat configuration and an erected configuration with said side panels and end panels substantially perpendicular to said base panel;

a cup holder associated with at least one of said end panels, said cup holder comprising a first part formed of a portion of said one end panel and hinged to said one end panel about a fold line and a second part formed of a portion of said base panel and hinged to said base panel about a fold line, wherein in said erect configuration of said tray, said cup holder may be selectively set in a retracted position with said first part substantially coplanar with said one end panel and said second part substantially coplanar with said base panel or an extended position with said first part substantially perpendicular to said one end panel and substantially parallel to said base panel and said second part substantially perpendicular to said base panel and substantially parallel to said one end panel.

11. A concession tray as in claim 10, wherein said first and second parts of said cup holder are connected to each other by one or more fold lines which permit said cup holder to be selectively set in the retracted position or the extended position.

12. A concession tray as in claim 10, wherein said end one panel in said erected configuration is higher than said second part of said cup holder in said extended position;

said one end panel intersecting said side panels and comprising extended portions which are attached to said side panels, whereby said end panel forms relatively high portions on each side of the intersections of said one end panel and adjacent side panels.

13. A concession tray as in claim 12, wherein said one end panel is higher than said side panels.

14. A concession tray as in claim 10, wherein said one end panel is higher than said second part of said cup holder when said tray is in the erected configuration and said cup holder is in said extended position.

15. A concession tray as in claim 10, wherein said one end panel and at least a portion of said side panels adjacent the intersections with said one end panel are higher than said second part of said cup holder when said tray is in the erected configuration and said cup holder is in said extended position.

16. A concession tray as in claim 10, wherein said first and second parts of said cup holder are hinged together at a fold line.

17. A concession tray as in claim 10, wherein said cup holder comprises a first cup holder fold line which defines the intersection of said first and second parts of said cup holder in the extended position, and a second cup holder fold line which is coincident with the fold line hinging said one end panel to said base panel when said cup holder is in the retracted position.

18. A concession tray as in claim 10, wherein said cup holder in the extended position forms a handle for carrying said tray.

19. A concession tray as in claim 10, wherein said tray is constructed of paperboard having a minimum thickness of 0.026 inches.

20. A concession tray as in claim 19, wherein the length and width of the base panel of said tray each does not exceed about 13.5 inches.

* * * * *